US006889882B1

(12) United States Patent
Leep

(10) Patent No.: US 6,889,882 B1
(45) Date of Patent: May 10, 2005

(54) BACKPACK STRAP SYSTEM FOR CARRYING LOADS OF VARIOUS SIZES AND/OR SHAPES

(76) Inventor: Michael S. Leep, 3739 Wickiup Pl., Redmond, OR (US) 97756

( * ) Notice: Subject to any disclaimer, the term of this patent is extended or adjusted under 35 U.S.C. 154(b) by 152 days.

(21) Appl. No.: 10/199,528

(22) Filed: Jul. 19, 2002

(51) Int. Cl.[7] ..... A45F 3/14

(52) U.S. Cl. ..... 224/579; 224/160; 224/250; 224/680; 224/921

(58) Field of Search ..... 224/159, 160, 224/250, 261, 576, 578, 579, 602, 603, 627, 628, 629, 678, 680, 907, 921

(56) References Cited

U.S. PATENT DOCUMENTS 2,407,787 A * 9/1946 Kernahan ..... 224/656
4,335,891 A * 6/1982 Alley et al. ..... 224/921
4,450,991 A * 5/1984 Gougeon ..... 224/159
4,887,823 A * 12/1989 Hallett et al. ..... 224/921
5,148,956 A * 9/1992 Funk ..... 224/576
5,243,724 A * 9/1993 Barnes ..... 224/159
5,579,966 A * 12/1996 Krumweide et al. ..... 244/637
5,918,785 A * 7/1999 Irose ..... 224/259
6,135,334 A * 10/2000 Seichter ..... 224/651
6,347,730 B1 * 2/2002 Frederick ..... 224/259
6,427,886 B1 * 8/2002 Essex ..... 224/259
6,443,339 B1 * 9/2002 Higuchi ..... 224/160
6,655,564 B1 * 12/2003 Zupan ..... 224/628

* cited by examiner

*Primary Examiner*—Gary E. Elkins
(74) *Attorney, Agent, or Firm*—David S. Alavi

(57) ABSTRACT

A backpack strap system for carrying a load comprises: an elongated sheet of flexible material; vertical load straps each attached at the top and bottom edges of the sheet; and horizontal load straps each attached at the first and second side edges of the sheet. Sheet and load straps are adapted for wrapping around and securing loads of various sizes and/or shapes. The top edge of the sheet is adapted for carrying the load, usually on foot, by shoulder straps, carrying straps, and/or a hanging strap secured thereto. The load is laid on the sheet, and the sheet and load straps are wrapped around the load to secure it, enabling the load to be lifted/carried. Examples of oversized loads include animal carcasses, firewood, or an injured person. The sheet may be adapted to fold up and function as an ordinary backpack, and/or to carry auxiliary packs or storage containers.

24 Claims, 12 Drawing Sheets

BACKPACK STRAP SYSTEM FOR CARRYING LOADS OF VARIOUS SIZES AND/OR SHAPES

FIELD OF THE INVENTION

The field of the present invention relates to backpacks. In particular, a backpack strap system is described herein for carrying loads of various sizes and/or shapes.

BACKGROUND

While hunting or otherwise enjoying the back country, it is often the case that loads of various sizes and/or shapes (including oversize loads) must be carried by people on foot, on horseback, or on an all-terrain vehicle (ATV). For example, successful hunters are often faced with the daunting task of hauling the kill back to a camp, dwelling, shelter, or vehicle (car or truck). In another not-uncommon situation, a person who has become ill, injured, or otherwise disabled or incapacitated may need to be carried out of the woods to safety and medical attention. Once again, the person's companions may be faced with the difficult task of transporting the person to a location accessible to emergency medical personnel, or repeated treks between the person and potential sources of assistance. In each of these cases, apparatus and methods for enabling a user (particularly if alone and on foot) to carry loads of various sizes and/or shapes would be of much utility. Such apparatus and methods may be particularly well-suited for carrying an oversize load (animal carcass, ill or injured companion, or other large load). However, any such apparatus must be lightweight and readily stowed or carried, given the outdoor or backwoods environment in which it would likely be needed. It is therefore desirable to provide apparatus and methods for carrying loads of various sizes and/or shapes that addresses various of these drawbacks.

SUMMARY

Certain aspects of the present invention may advance the state-of-the-art of backpacks and other carrying devices, and in addition may meet one or more of the following objects:

To provide a backpack strap system for enabling one user to carry an oversized load;

To provide a backpack strap system for carrying loads of various shapes and sizes;

To provide a backpack strap system wherein a sheet and several load straps are wrapped around the load;

To provide a backpack strap system wherein the load may be carried using shoulder straps;

To provide a backpack strap system wherein the load may be carried suspended from another backpack;

To provide a backpack strap system wherein the load may be carried suspended from a hook, saddle, or ATV;

To provide a backpack strap system for enabling one user to carry an oversized animal carcass or an oversized portion thereof;

To provide a backpack strap system for enabling one user to carry another person;

To provide a backpack strap system that may be converted to a standard backpack;

To provide a backpack strap system that may be converted to a standard backpack and that may carry removable auxiliary containers secured therein; and To provide a backpack strap system wherein an auxiliary pack may be carried;

To provide a backpack strap system that may be used for search and rescue operations and/or military operations.

One or more of the foregoing objects may be achieved in the present invention by an apparatus for carrying a load, the apparatus comprising: a) an elongated sheet of flexible material; b) two or more vertical load straps each attached at the top and bottom edges of the sheet; and c) two or more horizontal load straps each attached at the first and second side edges of the sheet. The sheet and load straps are adapted for wrapping around and securing loads or various sizes and/or shapes. The top edge of the sheet is adapted for carrying the load, usually on foot, by shoulder straps, carrying straps, and/or a hanging strap secured thereto. A load is laid on the upper portion of the sheet, and the bottom edge of the sheet is drawn up and over the load toward the top edge, thereby wrapping the sheet at least partially around the load. The load straps are wrapped around the load to secure it, enabling the load to be lifted and/or carried. Some examples of loads that might be carried are animal carcasses or parts thereof, firewood, or another person. The sheet may be further adapted to carry an auxiliary pack, to fold up and function as an ordinary backpack, and/or to carry auxiliary storage containers or pouches therein.

Additional objects and advantages of the present invention may become apparent upon referring to the preferred and alternative embodiments of the present invention as illustrated in the drawings and described in the following written description and/or claims.

The embodiments illustrated in the Figures are exemplary and should not be construed as limiting the scope of inventive concepts disclosed and/or claimed herein.

DETAILED DESCRIPTION OF PREFERRED AND ALTERNATIVE EMBODIMENTS

Figure 1:
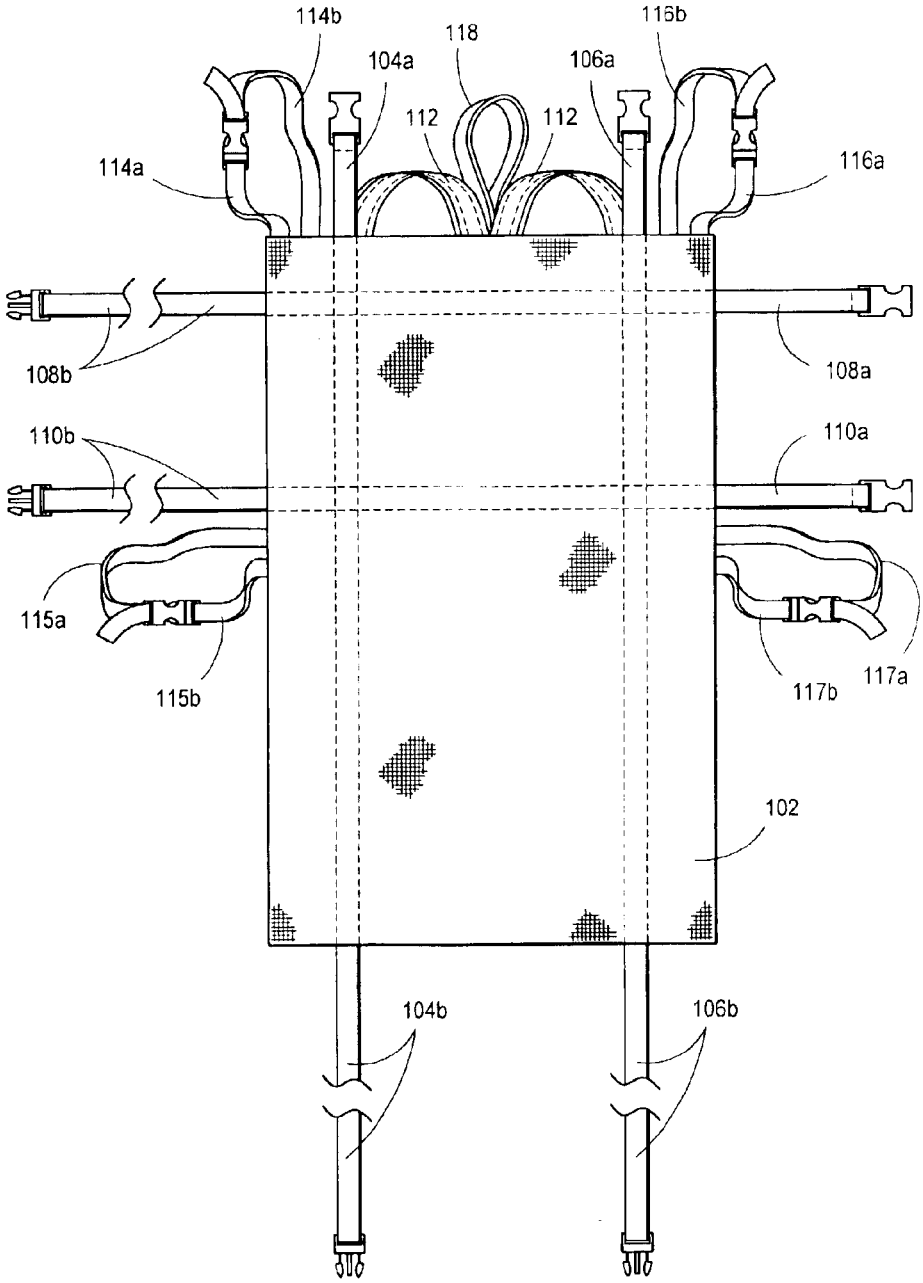
FIG. 1 shows a backpack strap system according to the present invention.

FIG. 1 shows an exemplary backpack strap system according to the present invention. A sheet 102 is elongated in a vertical direction and is provided with a first vertical load strap 104 divided into corresponding load strap segments 104*a* and 104*b*, and a second vertical load strap 106 divided into corresponding load strap segments 106*a* and 106*b*. Each of the vertical load straps are secured at each end thereof to the sheet near the top and bottom edges thereof, and are adapted so that the corresponding load strap segments may be repeatedly separated and reconnected (shown separated in FIG. 1). Sheet 102 is similarly provided with a first horizontal load strap 108 divided into corresponding horizontal load strap segments 108*a* and 108*b*, and a second horizontal load strap 110 divided into corresponding load strap segments 110*a* and 110*b*, also adapted for repeated separation and reconnection (shown separated in FIG. 1). Each pair of corresponding load strap segments may comprise the two ends of a single load strap spanning the sheet 102 in the relevant direction, with the strap secured to the sheet along a substantial portion of its length (as indicated by the dashed lines shown in FIG. 1). Alternatively, each pair of corresponding load strap segments may be a separate piece independently secured to sheet 102 (not shown). The straps may be adapted in any suitable way for repeated separation and reconnection, including buckles, clasps, ties, hooks, clips, buttons, snaps, hook-and-loop connectors (Velcro®), and so forth. The straps are preferably adapted for length adjustment in any suitable manner.

Figure 2:
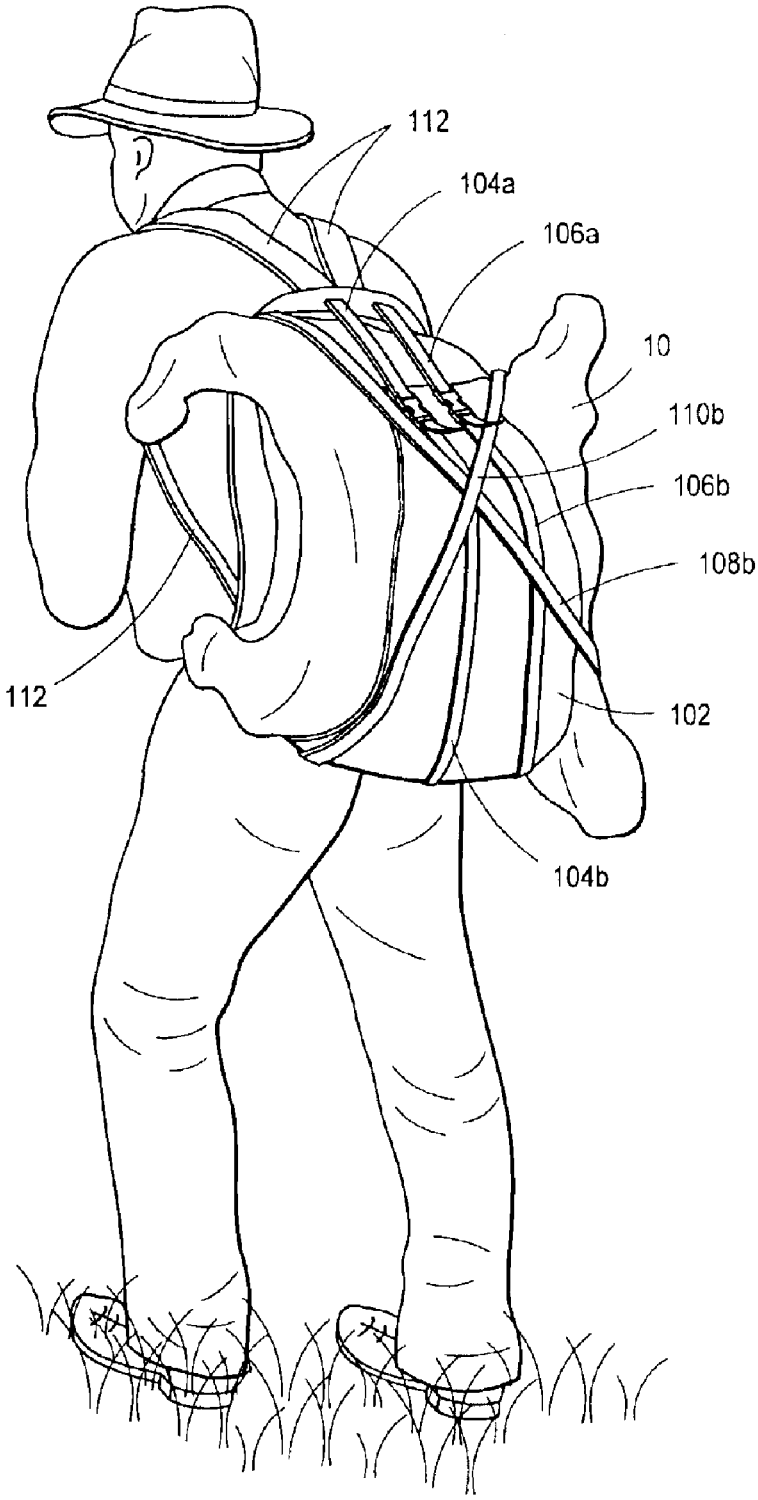
FIG. 2 shows a load being carried using a backpack strap system according to the present invention.
Figure 3A:
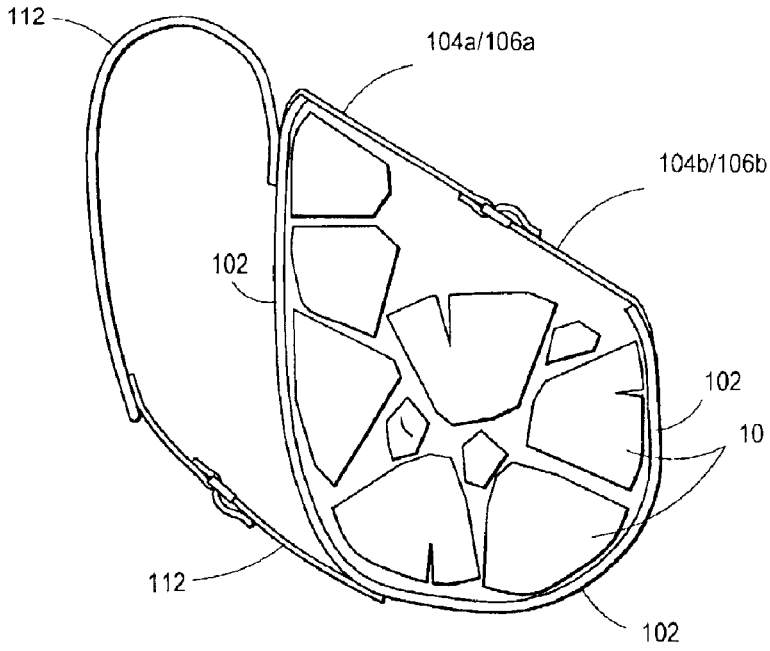
FIGS. 3A and 3B show a load ready to be carried using a backpack strap system according to the present invention.
Figure 3B:
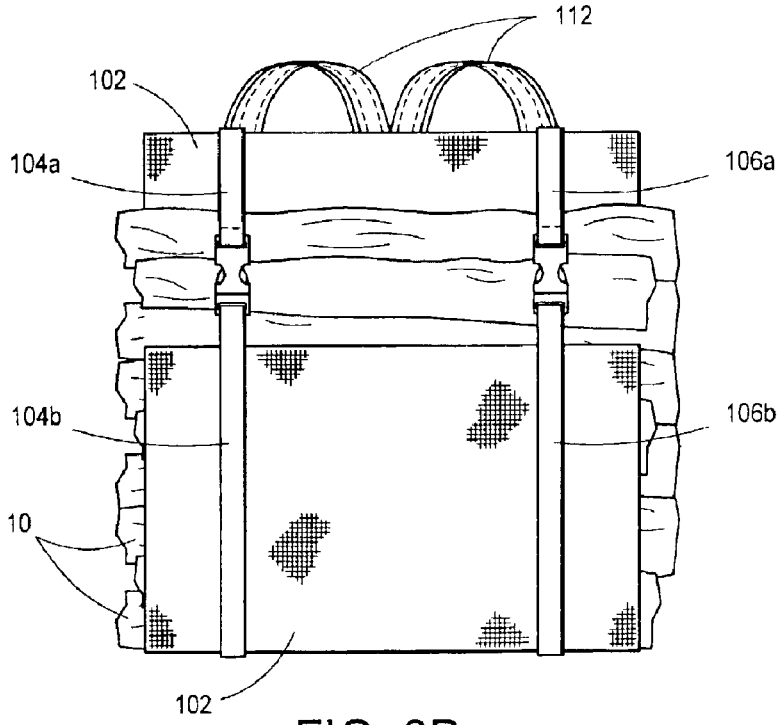
Figure 5A:
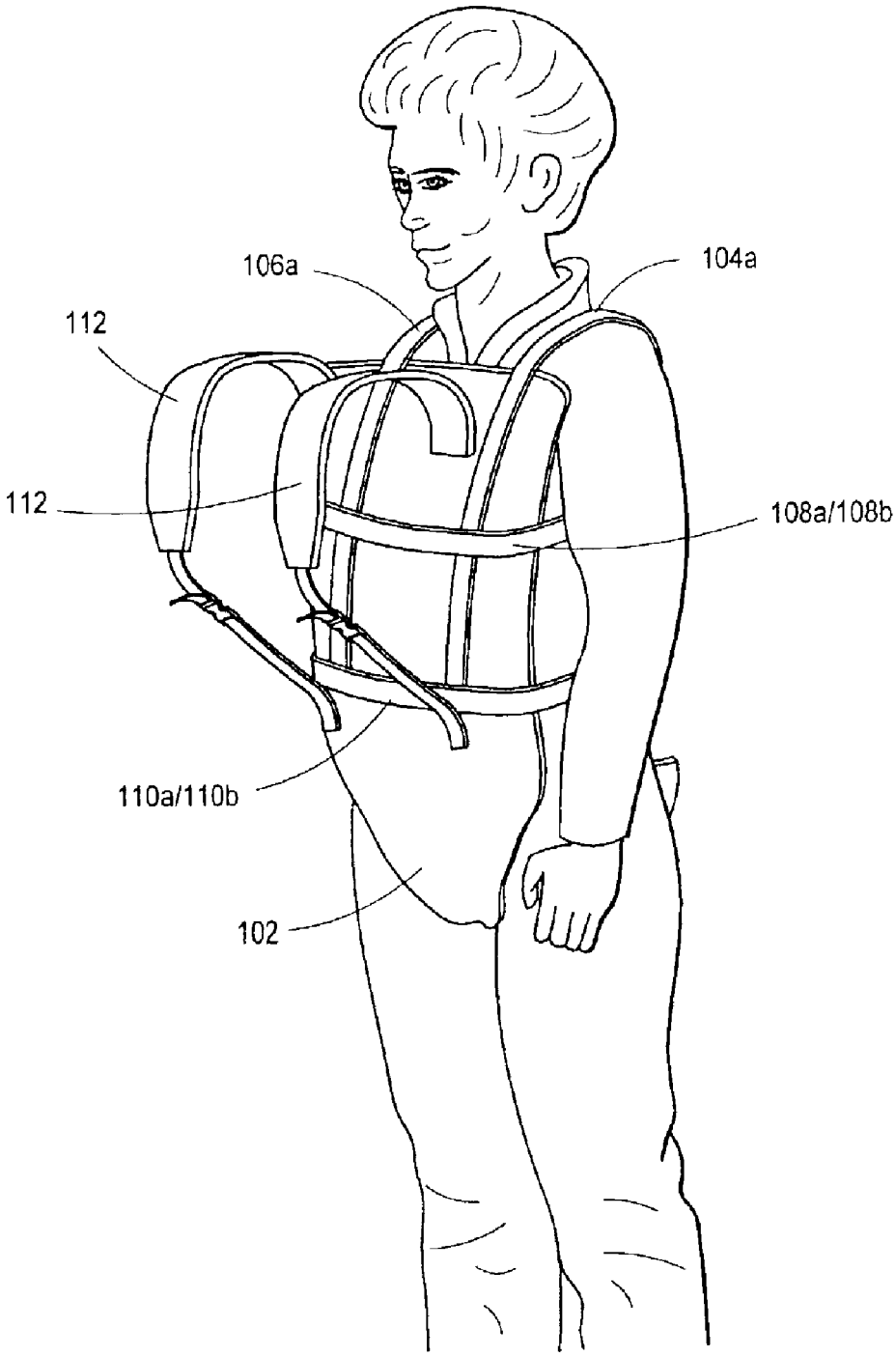
FIGS. 5A and 5B show a person ready to be carried using a backpack strap system according to the present invention.
Figure 5B:
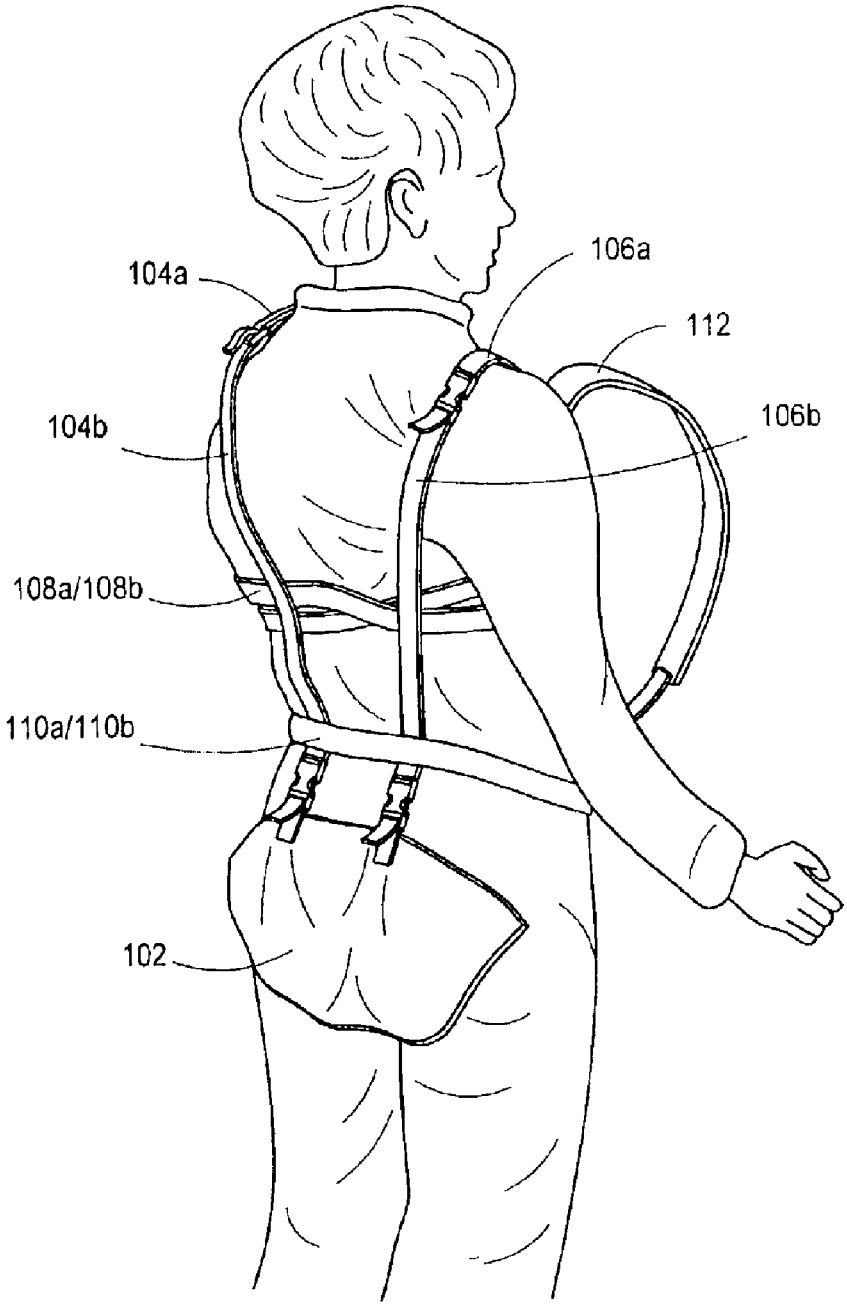
Figure 8A:
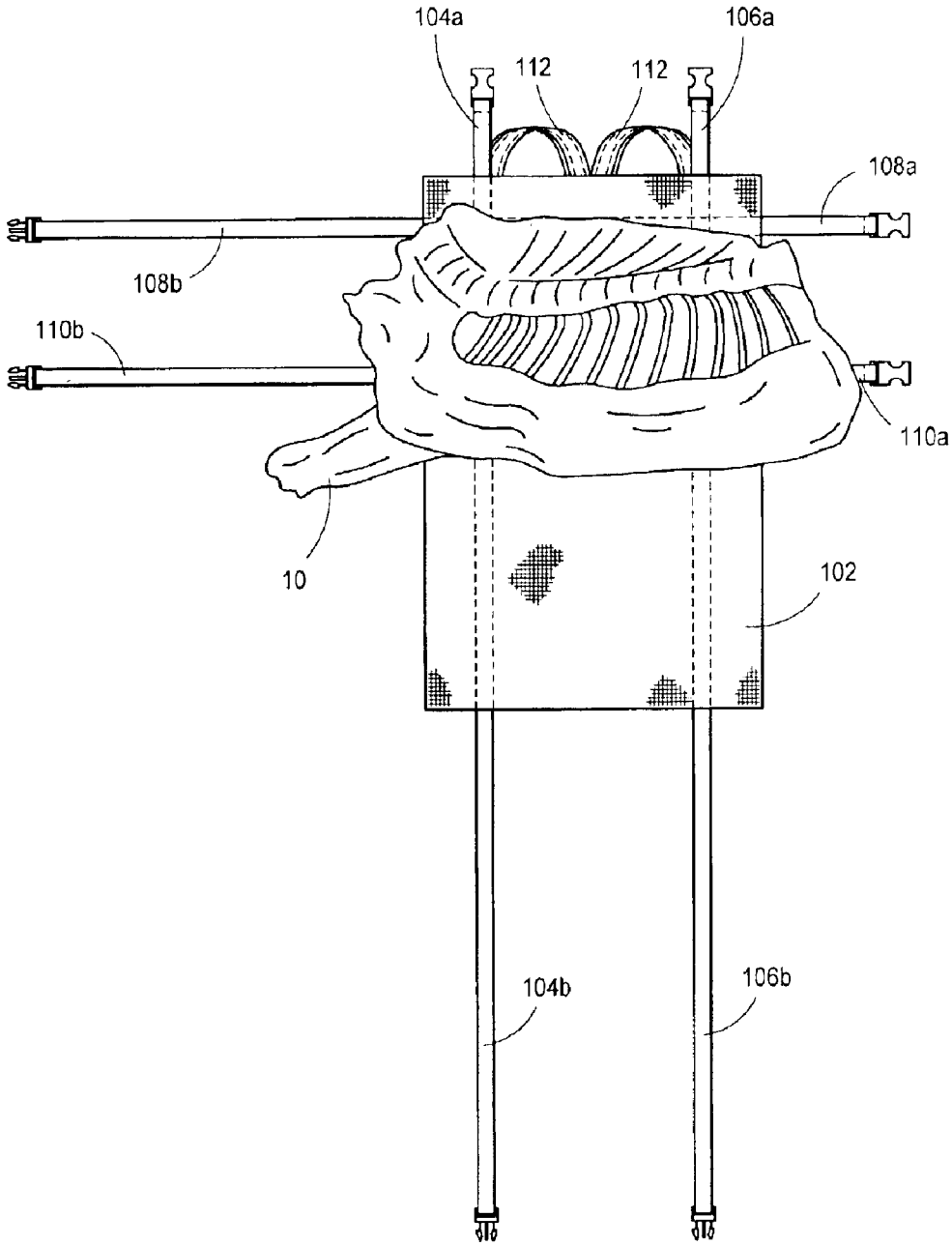
FIGS. 8A–8C illustrate a procedure for securing a load for carrying according to the present invention.
Figure 8B:
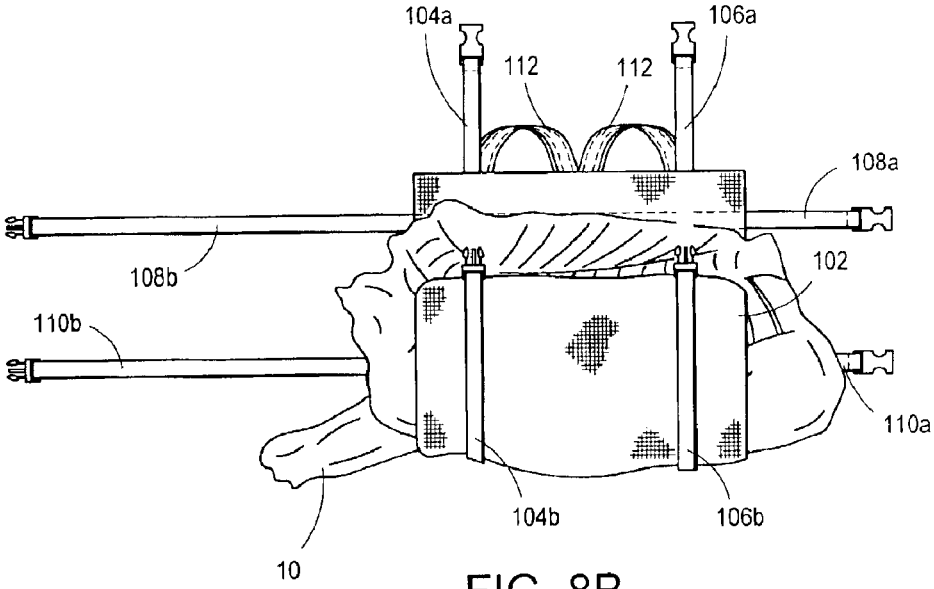
Figure 8C:
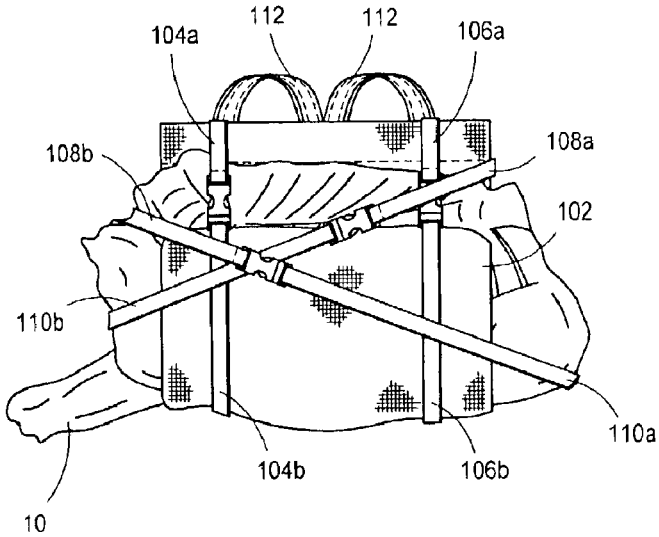

To secure a load, sheet 102 is laid substantially flat with the back surface of the sheet facing up and with the load straps separated (FIG. 8A). A load 10 is placed on an upper portion of the flattened sheet (FIG. 8A) and the bottom edge of the sheet is drawn upward toward the top edge of the sheet, thereby wrapping the sheet 102 at least partially around the load 10 (FIG. 8B). The load straps 104/106/108/110 are then wrapped at least partially around the load, adjusted for length, and connected (FIG. 8C) to secure the load. The load strap segments may be connected as shown in FIG. 3B and FIG. 5B ("straight-connected"), or some or all the load strap segments may be "cross-connected" (as in FIG. 2 and FIG. 8C) to better secure the load. Once secured by wrapping of the sheet and the load straps and connecting the load straps, the load is ready to be carried. The design of the present invention allows loads of widely varying size and/or shape to be carried. The design of the present invention enables a single user to readily carry an oversized load. ("Oversized" as used herein shall denote a load too large or awkwardly shaped for being carried in a standard backpack, and that would typically require two or more people to carry it any substantial distance without some sort of carrying aid.)

Sheet 102 is adapted near the top edge thereof for being lifted and carried once the load is secured. Shoulder straps 112 may be provided, attached at an upper end thereof to the sheet 102 near the top edge of the sheet and attached at a lower end thereof along side edges of the sheet. Shoulder straps 112 may be provided in any suitable manner, and may variously employ padding or cushioning, length adjustment, and/or connection/separation (via buckles, clips, ties, hooks, clasps, buttons, snaps, hook-and-loop connectors, and so forth as described above). The shoulder straps 112 enable a load to be carried with the shoulder straps 112 over the shoulders of a user 12, with the front surface of the sheet 102 in contact with the user's back (FIG. 2).

Figure 4:
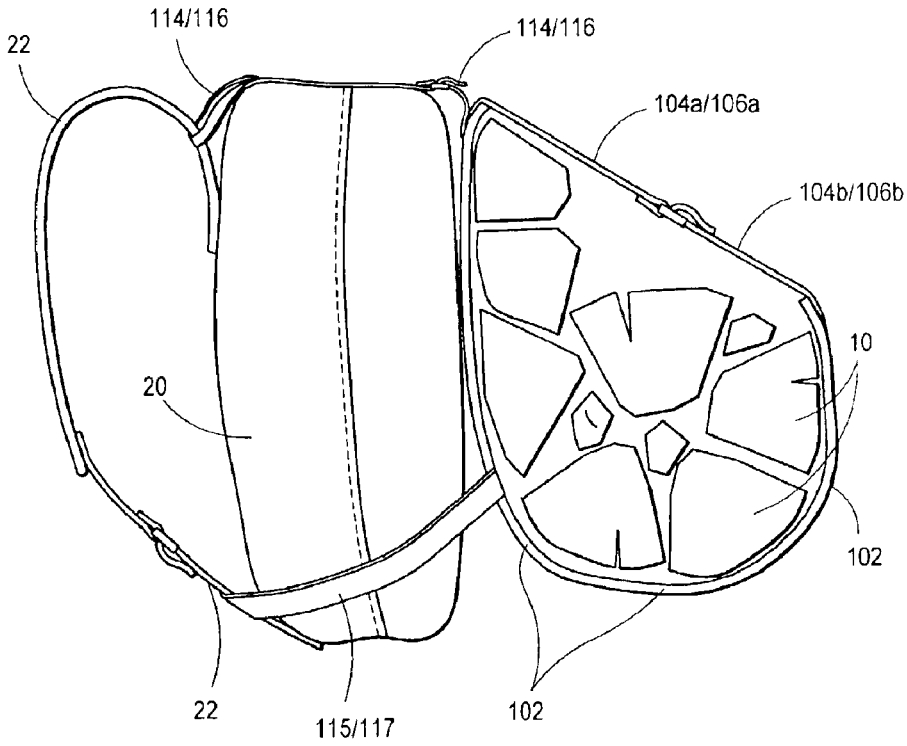
FIG. 4 shows a load ready to be carried using a backpack strap system according to the present invention.

Alternatively, sheet 102 may be provided with a pair of carrying straps 114 and 116, each having both ends attached to the sheet near the top edge. These carrying straps may be used to hang the sheet 102 (and any load wrapped therein) from the shoulder straps 22 of another backpack 20 (FIG. 4). As with the load straps, the carrying straps may be divided into segments 114*a*/114*b* and 116*a*/116*b* that are adapted in any suitable manner for repeated separation and reconnection, and may be provided in any suitable form. A load 10 wrapped in sheet 102 and load straps 104/106/108/110 may be carried with carrying straps 114/116 around shoulder straps 22 and with the front surface of sheet 102 in contact with backpack 20. It may be advantageous for a user to carry sheet 102 with its associated straps folded (or rolled) and stowed within backpack 20, to be removed and deployed if/when needed.

The top edge of the sheet 102 may be provided with a hanging strap 118 in the form of a loop attached near the top edge of the sheet. This hanging strap 118 allows the load (secured by the wrapped sheet and load straps) to be hung. The load may be hung from a saddle on an horse, or hung from an ATV or other ground vehicle. Alternatively, the hanging strap may be used to hang the load on a hook, particularly a hook provided on a winch cable for hoisting the load. Other uses of a hanging strap may be implemented while remaining within the scope of inventive concepts disclosed and/or claimed herein.

A backpack strap system according to the present invention is well-suited for carrying oversize loads on foot, i.e., loads that may not fit readily into a backpack of a typical size. A wide variety of load sizes and/or shapes may be accommodated for carrying using the backpack strap system of the present invention. One type of oversized load that may commonly require carrying on foot results from hunting. The dead animal might be quite large (such as an elk or moose, for example), and transporting the carcass from the place where the kill was made may prove quite problematic. A strap system according to the present invention enables one hunter to carry a quarter of an adult elk (after gutting, cleaning, and quartering) with relative ease (FIG. 2), so that a hunter or hunting party may more readily transport the desired portions of the carcass out of the woods, to a camp, dwelling, shelter, or vehicle. The desirability of the stowable nature of the backpack strap system according to the present invention is apparent for this particular use. The stowed backpack strap system may be carried by a hunter stowed in his/her ordinary backpack, knapsack, fanny-pack, or other carrier, but then readily removed and deployed for use if a kill is made. Another oversize load for which the present invention is suitable is firewood, as shown in FIGS. 3A/3B and FIG. 4. A backpack strap system according to the present invention may be used for enabling a single user to carry a lightweight watercraft (such as a kayak, either rigid or inflatable; lightweight perhaps, but certainly oversized and awkwardly shaped for one person to carry) down to the waterside or along a portage way. Many other oversized and/or awkwardly shaped loads may be carried as well.

Another preferred use for the present invention is for wilderness search and rescue and/or military operations. As shown in FIGS. 5A/5B, the backpack strap system according to the present invention may be employed to enable a single person to carry another person (if injured, wounded, or otherwise disabled, for example). As shown in FIGS. 5A/5B, the bottom edge of the sheet is passed through the injured person's legs with the top edge of the sheet at the person's shoulders and the back surface of sheet 102 against the person's torso, preferably the front of the person's torso. Vertical load straps 104/106 pass over the person's shoulders, are adjusted for length (if necessary), and are connected together. Horizontal load straps 108/110 may be wrapped around the person's torso, adjusted for length (if necessary), and connected together. The person thus secured may then be lifted and carried as previously disclosed herein: shoulder straps 112 enable a user to carry the person on the user's back (FIGS. 5A/5B); carrying straps 114/116 (not shown in FIG. 5A) enable a user to carry the person on the user's shoulders on another backpack; the person may be hoisted by a hanging strap 118 (not shown in FIG. 5A). The hoisting option using a hanging strap 118 may be particularly useful for hoisting a person from the ground into a rescue helicopter.

Figure 6:
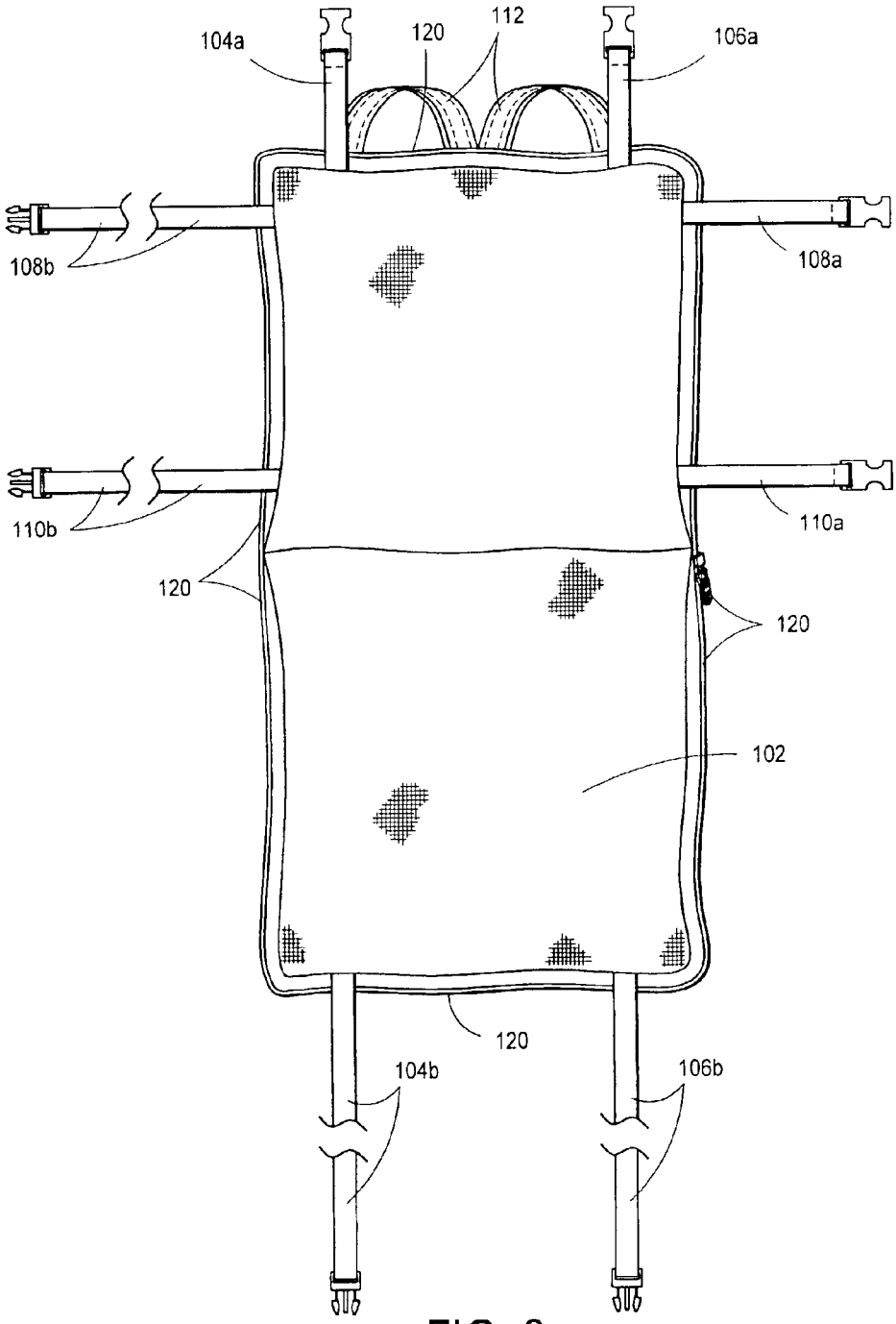
FIG. 6 shows a backpack strap system according to the present invention.
Figure 7:
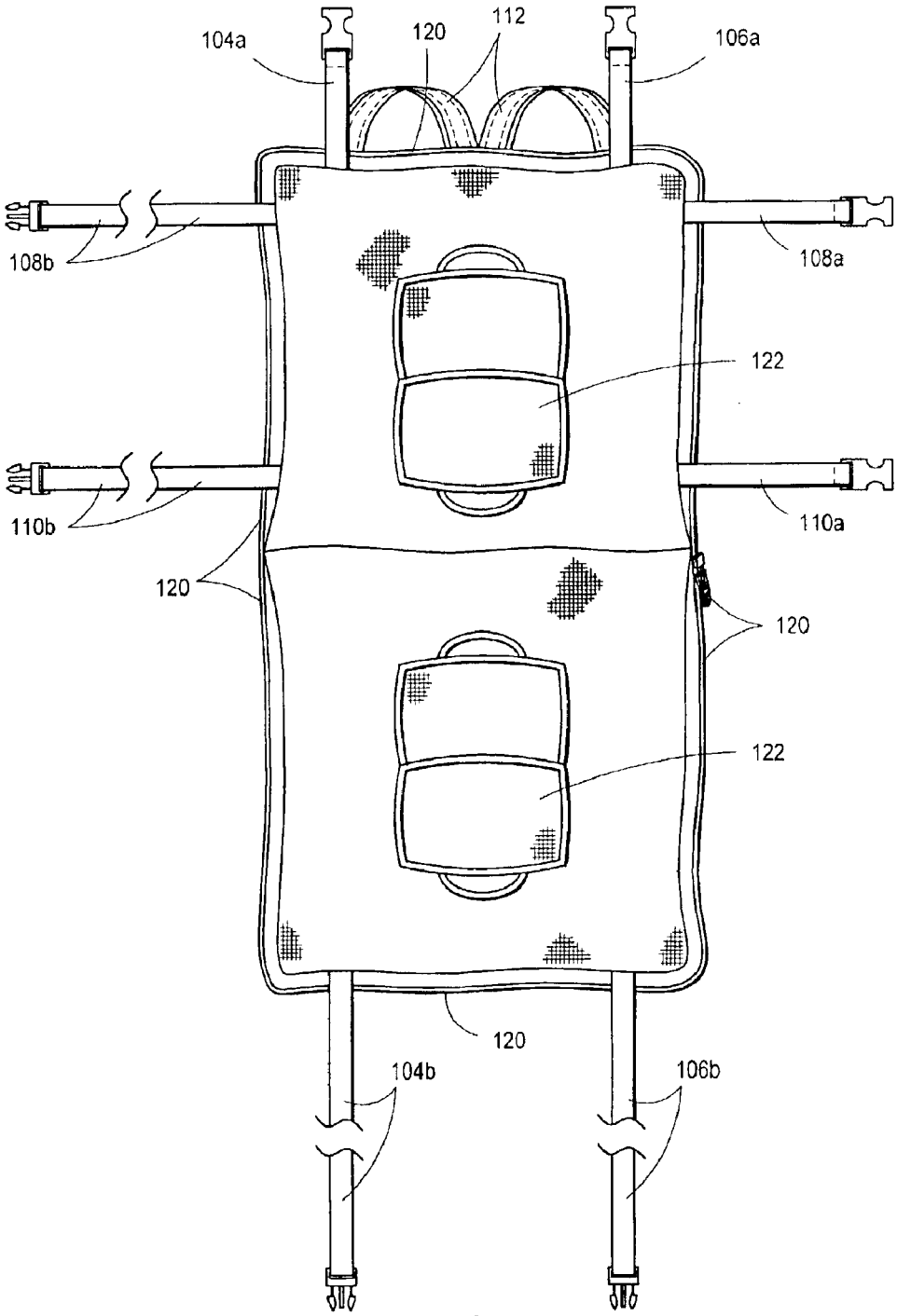
FIG. 7 shows a backpack strap system according to the present invention.

In an alternative embodiment shown in FIG. 6, sheet 102 may be provided along the edges thereof with zippers 120 or other closures. The sheet 102 is folded upward with the bottom edge of the sheet 102 pulled up to the top edge, and at least a fraction of the zippers (or other closures) engaged to form an enclosed storage volume, with the back surface of the sheet forming the inner surface of the storage volume. The load straps may be stowed inside the storage volume along with any carried contents when sheet 102 is thus configured as a typical backpack. As described hereinabove, the upper edge of sheet 102 may be provided with shoulder straps 112, carrying straps 114/116, and/or hanging loop 118 (not shown in FIG. 6) for carrying the backpack-configured sheet and contents enclosed therein. By disengaging the zippers (or other closures) and unfolding sheet 102, the sheet and loading straps may be used as described hereinabove for securing loads of various sizes and/or shapes to be carried. Even when adapted for enabling configuration as a typical backpack, sheet 102 may be used in any of the ways described hereinabove. In particular, while configured as a backpack, the sheet/straps may be employed to carry medical equipment to a remote incident scene (injury or illness). The sheet/straps may then be unzipped and unfolded and used to transport the person requiring the medical attention, as described hereinabove. The sheet 102 may be further provided with removable equipment pouches 122 (or other auxiliary storage container) secured to the back surface (i.e., interior surface) of the sheet, as shown in FIG. 7. Removable containers 122 may be secured to sheet 102 using buckles, clips, ties, hooks, clasps, buttons, snaps, hook-and-loop connectors, and so forth as described above.

Figure 9:
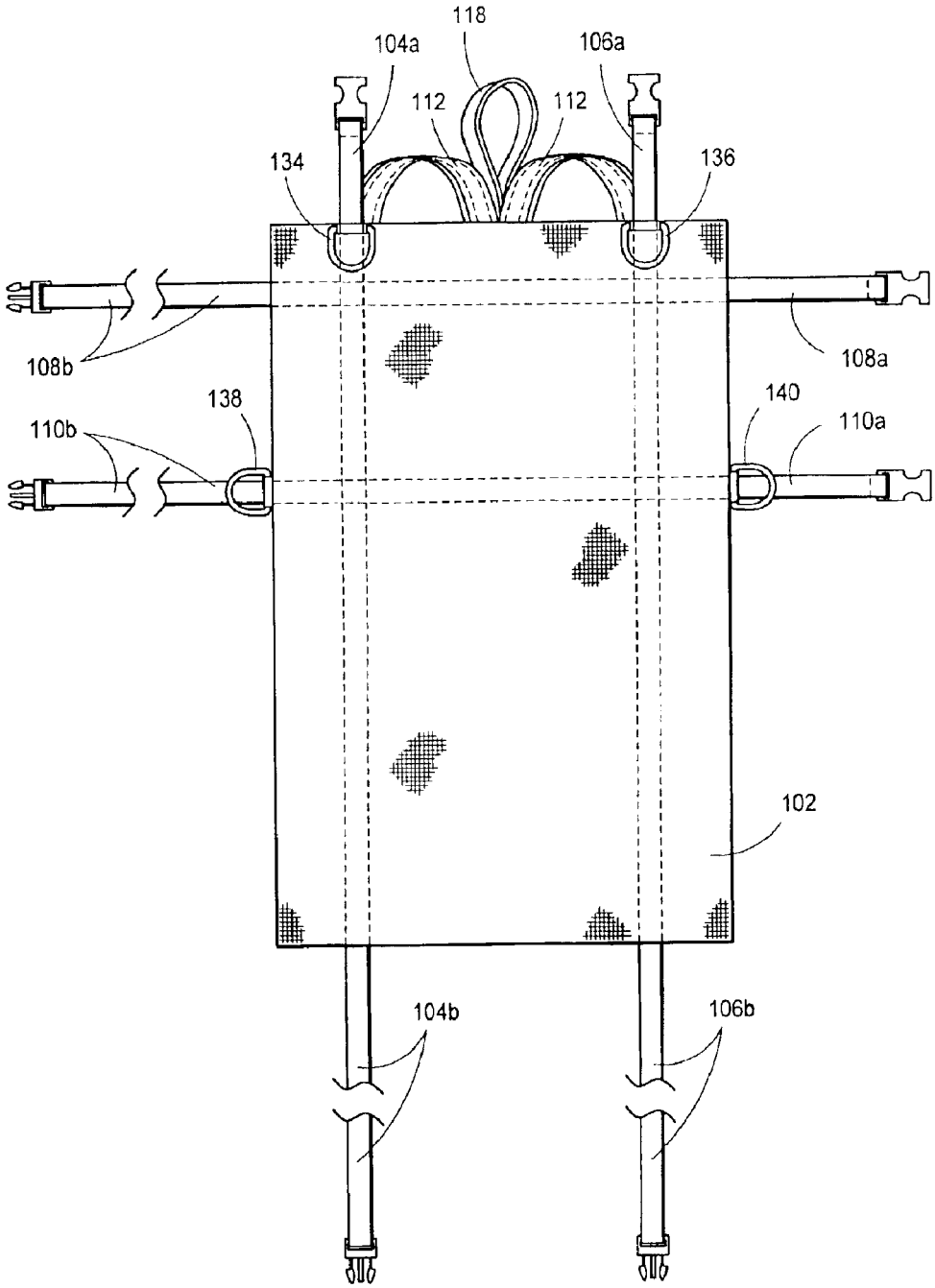
FIG. 9 shows a backpack strap system according to the present invention.
Figure 10:
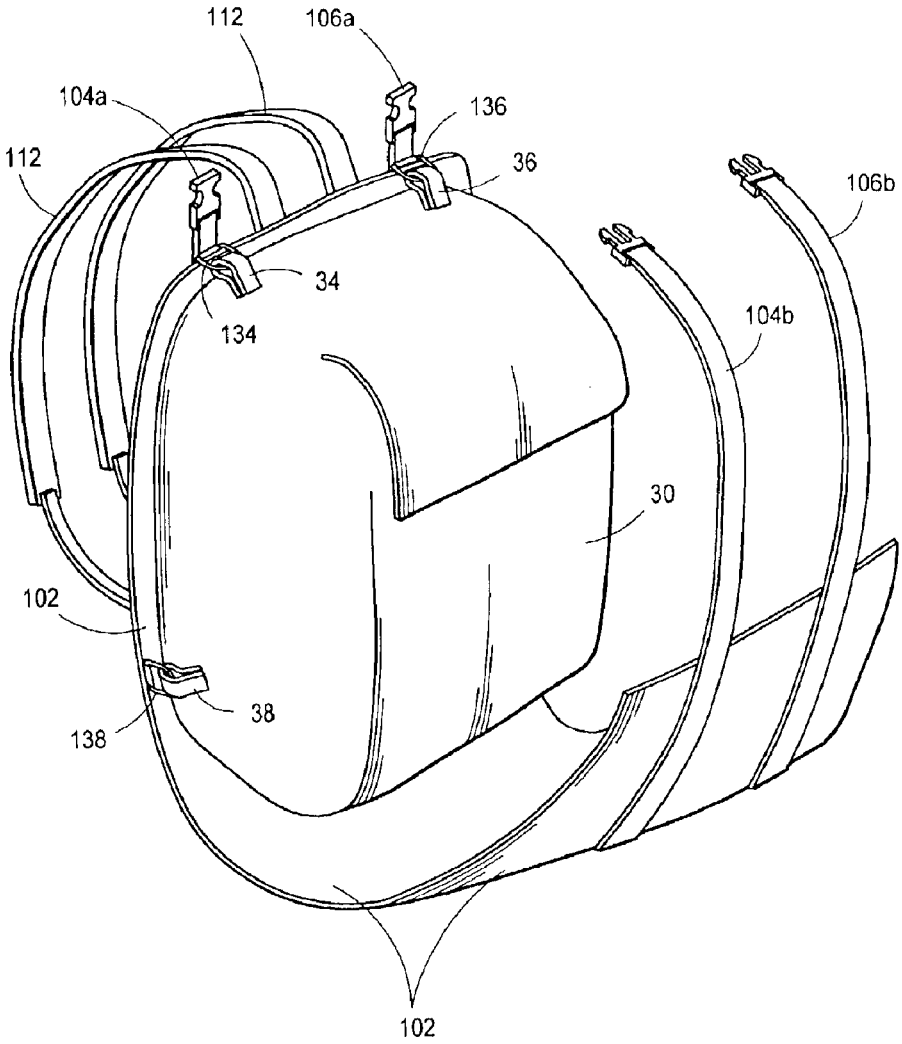
FIG. 10 shows an auxiliary pack carried by a backpack strap system according to the present invention.

An alternative embodiment of the present invention is shown in FIGS. 9 and 10. Instead of (or perhaps in addition to) carrying straps 114/115/116/117, sheet 102 may be provided near the top and side edges with attachment devices 134/136/138/140, shown as metal D-rings in FIGS. 9 and 10. An auxiliary pack 30 may be provided with pack attachment devices 34/36/38/40, shown in FIG. 10 as straps attached to pack 30 and each threaded through a corresponding one of the sheet attachment devices 134/136/138/140, thereby securing auxiliary pack 30 to sheet 102. Sheet 102, vertical load straps 104/106, and horizontal loads straps 108/110 (not shown in FIG. 10) may be wrapped around auxiliary pack 30 to further secure it to sheet 102, if desired. The auxiliary pack 30 thus secured to sheet 102 may then be carried in any of the ways described hereinabove, preferably by means of straps 112 on the shoulders of a user. Sheet attachment devices 134/136/138/140 and corresponding pack attachment devices 34/36/38/40 may be any suitable attachment devices, including rings, straps, buckles, clips, ties, hooks, clasps, buttons, snaps, hook-and-loop connectors, and so forth as described above.

Sheet 102 may be made from nylon or canvas or any other sufficiently strong flexible material, especially those typically used (or hereafter developed) for backpack construction. Other exemplary materials may include polypropylene or other plastics, Gortex®, and so forth. Similarly, load straps, carrying straps, hanging straps, and shoulder straps may be fabricated from nylon, canvas, leather, or other sufficiently strong flexible material. It may be desirable to use water-resistant or water-proof materials to facilitate cleaning, particularly if the backpack strap system will be used to carry animal carcasses when hunting. Instead of a continuous sheet 102, netting, webbing, or mesh may be equivalently employed.

The present invention has been set forth in the forms of its preferred and alternative embodiments. It is nevertheless intended that modifications to the disclosed backpack strap system for carrying loads of various sizes and/or shapes may be made without departing from inventive concepts disclosed and/or claimed herein.

What is claimed is:

1. An apparatus for carrying a load, comprising:

an elongated sheet of flexible material, the sheet being elongated in a vertical direction and having a top edge, a bottom edge, a first side edge, a second side edge, a front surface, and a back surface;

a first vertical load strap, the first vertical load strap being attached at an upper end thereof to the sheet near the top edge of the sheet and at a lower end thereof to the sheet near the lower edge of the sheet;

a second vertical load strap, the second vertical load strap being attached at an upper end thereof to the sheet near the top edge of the sheet and at a lower end thereof to the sheet near the lower edge of the sheet;

a first horizontal load strap, the first horizontal load strap being attached at a first end thereof to the sheet near the first side edge of the sheet and attached at a second end thereof to the sheet near a second side edge of the sheet; and a second horizontal load strap, the second horizontal load strap being attached at a first end thereof to the sheet near the first side edge of the sheet and attached at a second end thereof to the sheet near a second side edge of the sheet, each of the first and second vertical load straps and the first and second horizontal load straps being divided at a point between the respective first and second ends thereof into respective load strap segments and adapted for repeated separation and reconnection of the load strap segments, the sheet being adapted for laying substantially flat for receiving the load and for being wrapped at least partially around the load with the top and bottom edges of the sheets being drawn toward each other and with the back surface of the sheet in contact with the load, the first and second vertical load straps and the first and second horizontal load straps being adapted for being wrapped at least partially around the load with the sheet wrapped at least partially around the load and with the respective load strap segments connected, the sheet being adapted near the top edge thereof for enabling the load to be carried with the sheet, the first and second vertical load straps, and the first and second horizontal load straps being at least partially wrapped around the load, with the respective load strap segments connected, and with the back surface of the sheet in contact with the load.

2. A method for using the apparatus of claim 1, the method comprising the steps of laying the sheet substantially flat with the front surface of the sheet in contact with a substantially horizontal surface and with the respective load strap segments separated;

placing a load on the back surface of the sheet;

wrapping the sheet at least partially around the load by drawing the top and bottom edges of the sheet toward one another around the load;

wrapping the first and second vertical load straps and the first and second horizontal load straps at least partially around the load and connecting the respective load strap segments; and lifting the load by the top edge of the sheet and carrying the load.

3. The method of claim 2, the load being a quarter of a game animal.

4. The apparatus of claim 1, the sheet, the first and second vertical load straps and the first and second horizontal load straps being adapted for carrying a person as the load, provided that:

the lower edge of the sheet passes through the person's legs with the back surface of the sheet in contact with the person's torso;

the first and second vertical load straps pass over the person's shoulders with the respective vertical load strap segments connected; and the first and second horizontal load straps are wrapped at least partially around the person's torso with the respective horizontal load strap segments connected.

5. A method for carrying a person using the apparatus of claim 1, the method comprising the steps of:

positioning the sheet with the top edge thereof at the person's shoulders and the back surface thereof in contact with the person's torso;

passing the bottom edge of the sheet through the person's legs and then drawing the bottom edge of the sheet upward toward the top edge of the sheet;

passing the first and second vertical load straps over the person's shoulders and connecting the respective vertical load strap segments;

wrapping the first and second horizontal load straps at least partially around the person's torso and connecting the respective horizontal load strap segments; and lifting the person by the top edge of the sheet and carrying the person.

6. The apparatus of claim 1, further comprising:

a first shoulder strap, the first shoulder strap being attached at an upper end thereof to the sheet near the top edge of the sheet and attached at a lower end thereof to the sheet near the first side edge of the sheet; and a second shoulder strap, the second shoulder strap being attached at an upper end thereof to the sheet near the top edge of the sheet and attached at a lower end thereof to the sheet near the second side edge of the sheet, the shoulder straps being adapted for enabling a user to carry the load with the shoulder straps over the user's shoulders and with the front surface of the sheet in contact with the user's back.

7. A method for using the apparatus of claim 6, the method comprising the steps of:

laying the sheet substantially flat with the front surface of the sheet in contact with a substantially horizontal surface and with the respective load strap segments separated;

placing the load on the back surface of the sheet;

wrapping the sheet at least partially around the load by drawing the top and bottom edges of the sheet toward one another around the load;

wrapping the first and second vertical load straps and the first and second horizontal load straps at least partially around the load and connecting the respective load strap segments; and carrying the load with the shoulder straps over the shoulder's of a user and the front surface of the sheet in contact with the user's back.

8. The apparatus of claim 1, further comprising:

a first carrying strap, the first carrying strap being attached at both ends thereof to the sheet near the top edge of the sheet; and a second carrying strap, the second carrying strap being attached at both ends thereof to the sheet near the top edge of the sheet, each of the first and second carrying straps being divided at a point between the respective first and second ends thereof into respective carrying strap segments and adapted for repeated separation and reconnection of the carrying strap segments, the carrying straps being adapted for enabling a user to carry the load with the carrying straps wrapped around upper portions of the shoulder straps of a backpack, with the respective carrying strap segments connected, and with the front surface of the sheet in contact with the backpack, the backpack being carried on the user's shoulders in contact with the user's back.

9. A method for using the apparatus of claim 8, the method comprising the steps of:

laying the sheet substantially flat with the front surface of the sheet in contact with a substantially horizontal surface and with the respective load strap segments separated;

placing the load on the back surface of the sheet;

wrapping the sheet at least partially around the load by drawing the top and bottom edges of the sheet toward one another around the load;

wrapping the first and second vertical load straps and the first and second horizontal load straps at least partially around the load and connecting the respective load strap segments;

positioning the sheet and the load wrapped therein with the front surface of the sheet facing a back surface of a backpack;

wrapping the first and second carrying straps around upper portions of corresponding first and second shoulder straps of the backpack and connecting the respective carrying straps segments; and carrying the backpack with the shoulder straps over the shoulder's of a user and a front surface of the backpack in contact with the user's back, thereby also carrying the load.

10. The apparatus of claim 8, further comprising:

a third carrying strap, the third carrying strap being attached at both ends thereof to the sheet near the first edge of the sheet; and a fourth carrying strap, the fourth carrying strap being attached at both ends thereof to the sheet near the second edge of the sheet, each of the third and fourth carrying straps being divided at a point between the respective first and second ends thereof into respective carrying strap segments and adapted for repeated separation and reconnection of the carrying strap segments, the third and fourth carrying straps being adapted for enabling a user to carry the load with the third and fourth carrying straps wrapped around lower portions of the shoulder straps of the backpack, with the respective carrying strap segments connected, and with the front surface of the sheet in contact with the backpack, the backpack being carried on the user's shoulders in contact with the user's back.

11. A method for using the apparatus of claim 10, the method comprising the steps of:

laying the sheet substantially flat with the front surface of the sheet in contact with a substantially horizontal surface and with the respective load strap segments separated;

placing the load on the back surface of the sheet;

wrapping the sheet at least partially around the load by drawing the top and bottom edges of the sheet toward one another around the load;

wrapping the first and second vertical load straps and the first and second horizontal load straps at least partially around the load and connecting the respective load strap segments;

positioning the sheet and the load wrapped therein with the front surface of the sheet facing a back surface of a backpack;

wrapping the first and second carrying straps around the upper portions of the corresponding first and second shoulder straps of the backpack and connecting the respective carrying straps segments;

wrapping the third and fourth carrying straps around the lower portions of the corresponding first and second shoulder straps of the backpack and connecting the respective carrying straps segments; and carrying the backpack with the shoulder straps over the shoulder's of a user and a front surface of the backpack in contact with the user's back, thereby also carrying the load.

12. The apparatus of claim 1, further comprising a hanging strap, the hanging strap being attached at both ends thereof to the sheet near the top edge of the sheet, the hanging strap being adapted for enabling the load to be hung by the hanging strap.

13. A method for using the apparatus of claim 12, the method comprising the steps of:

laying the sheet substantially flat with the front surface of the sheet in contact with a substantially horizontal surface and with the respective load strap segments separated;

placing the load on the back surface of the sheet;

wrapping the sheet at least partially around the load by drawing the top and bottom edges of the sheet toward one another around the load;

wrapping the first and second vertical load straps and the first and second horizontal load straps at least partially around the load and connecting the respective load strap segments; and lifting the load by the hanging strap and carrying the load.

14. The method of claim 13, further comprising the step of hanging the load from a saddle on a horse using the hanging strap.

15. The method of claim 13, further comprising the step of hanging the load from a ground vehicle using the hanging strap.

16. The method of claim 13, the load being lifted and carried by hook provided on a winch cable.

17. The method of claim 13, the load being lifted and carried by hook provided on a winch cable, the winch cable being suspended from a helicopter.

18. The apparatus of claim 1, the sheet being provided with at least one closure at the top edge thereof and at least one corresponding closure at the bottom edge thereof, the sheet being provided with at least one closure along a top portion of the first side edge thereof and at least one corresponding closure along a bottom portion of the first side edge thereof, the sheet being provided with at least one closure along a top portion of the second side edge thereof and at least one corresponding closure along a bottom portion of the second side edge thereof, drawing the top and bottom edges of the sheet together and engaging at least a fraction of the top edge, first side edge, and second side edge closures with the corresponding bottom edge, first side edge, and second side edge closures thereby forming a substantially enclosed storage volume, at least a portion of the back surface of the sheet forming at least a portion of an interior surface of the storage volume.

19. A method for using the apparatus of claim 18, comprising the steps of:

engaging at least a fraction of the top edge, first side edge, and second side edge closures with the corresponding bottom edge, first side edge, and second side edge closures with a load within the enclosed storage volume;

lifting the load by the top edge of the sheet and carrying the load.

20. A method for using the apparatus of claim 18, comprising the steps of:

disengaging the top edge, first side edge, and second side edge closures from the corresponding bottom edge, first side edge, and second side edge closures;

laying the sheet substantially flat with the front surface of the sheet in contact with a substantially horizontal surface and with the respective load strap segments separated;

placing the load on the back surface of the sheet;

wrapping the sheet at least partially around the load by drawing the top and bottom edges of the sheet toward one another around the load;

wrapping the first and second vertical load straps and the first and second horizontal load straps at least partially around the load and connecting the respective load strap segments; and lifting the load by the top edge of the sheet and carrying the load.

21. The apparatus of claim 18, further comprising at least one auxiliary storage container positioned within the interior storage volume and adapted for being repeatedly secured therein and removed therefrom.

22. The apparatus of claim 1, further comprising:

at least one sheet attachment device attached to the sheet near each of the top, first side, and second side edges thereof; and an auxiliary pack including pack attachment devices, the pack attachment devices being secured to the pack, corresponding to the sheet attachment devices, and being adapted for attachment to the sheet attachment devices, the auxiliary pack being adapted for being carried in lieu of the load while being secured to the sheet by attachment of the sheet attachment devices to the corresponding pack attachment devices.

23. A method for using the apparatus of claim 22, comprising the steps of:

laying the sheet substantially flat with the front surface of the sheet in contact with a substantially horizontal surface;

placing the auxiliary pack on the back surface of the sheet;

attaching the sheet attachment devices to the corresponding pack attachment devices; and lifting the load by the top edge of the sheet and carrying the load.

24. The method of claim 23, further comprising the steps of:

wrapping the sheet at least partially around the auxiliary pack by drawing the top and bottom edges of the sheet toward one another around the auxiliary pack; and wrapping at least one of the first and second vertical load straps and the first and second horizontal load straps at least partially around the load and connecting the respective load strap segments, thereby further securing the auxiliary pack.

* * * * *